US008186945B2

(12) United States Patent
Bhatnagar et al.

(10) Patent No.: US 8,186,945 B2
(45) Date of Patent: May 29, 2012

(54) SYSTEM AND METHOD FOR CLEARANCE CONTROL

(75) Inventors: Shubhra Bhatnagar, Bangalore (IN); Chakrakody Girish Shastry, Bangalore (IN)

(73) Assignee: General Electric Company, Schenectady, NY (US)

( * ) Notice: Subject to any disclaimer, the term of this patent is extended or adjusted under 35 U.S.C. 154(b) by 451 days.

(21) Appl. No.: 12/472,195

(22) Filed: May 26, 2009

(65) Prior Publication Data

US 2010/0303612 A1 Dec. 2, 2010

(51) Int. Cl.
*F01D 11/08* (2006.01)

(52) U.S. Cl. ..... 415/173.2; 415/173.1

(58) Field of Classification Search ..... 415/173.1, 415/173.3, 174.2, 173.2
See application file for complete search history.

(56) References Cited

U.S. PATENT DOCUMENTS

| | | | | |
|---|---|---|---|---|
| 5,263,816 | A | 11/1993 | Weimer et al. | |
| 6,220,602 | B1 * | 4/2001 | Webster et al. | 277/410 |
| 6,543,992 | B2 * | 4/2003 | Webster | 415/10 |
| 7,249,769 | B2 * | 7/2007 | Webster | 277/411 |
| 2001/0001845 | A1 * | 5/2001 | Khalid et al. | 701/100 |
| 2005/0149274 | A1 * | 7/2005 | Finnigan et al. | 702/33 |
| 2005/0217273 | A1 * | 10/2005 | Muramatsu et al. | 60/773 |
| 2005/0286995 | A1 * | 12/2005 | Shang et al. | 415/1 |
| 2009/0128166 | A1 * | 5/2009 | Webster | 324/662 |
| 2009/0297330 | A1 * | 12/2009 | Razzell et al. | 415/1 |
| 2010/0247283 | A1 * | 9/2010 | Andrew et al. | 415/1 |

FOREIGN PATENT DOCUMENTS

| | | | |
|---|---|---|---|
| EP | 578285 | A1 | 1/1994 |
| EP | 1900907 | A2 | 3/2008 |
| GB | 2336408 | | 7/2002 |
| GB | 2440744 A | * | 2/2008 |

OTHER PUBLICATIONS

U.S. Appl. No. 12/411,275, filed Mar. 25, 2009, Philip L. Andrew.

* cited by examiner

*Primary Examiner* — Edward Look
*Assistant Examiner* — Christopher R Legendre
(74) *Attorney, Agent, or Firm* — Fletcher Yoder P.C.

(57) ABSTRACT

A system, in one embodiment, includes a turbine clearance controller. The turbine clearance controller is configured to independently adjust clearances of a plurality of shroud segments about a plurality of blades via first and second magnets opposite from one another in fixed and movable portions of each shroud segment.

20 Claims, 8 Drawing Sheets

SYSTEM AND METHOD FOR CLEARANCE CONTROL

BACKGROUND OF THE INVENTION

The subject matter disclosed herein relates to clearance control techniques, and more particularly to a system for adjusting the clearance between a stationary component and a rotary component of a rotary machine.

In certain applications, a clearance may exist between components that move relative to one another. For example, a clearance may exist between rotary and stationary components in a rotary machine, such as a compressor, turbine, or the like. The clearance may increase or decrease during operation of the rotary machine due to temperature changes or other factors. In turbine engines, it is desirable to provide greater clearance during transient conditions, such as start-up (e.g., to mitigate the occurrence of a rub between a turbine blade and a shroud), while providing lesser clearance during steady-state conditions (e.g., to increase power output and operational efficiency).

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In one embodiment, a system includes a turbine engine. The turbine engine includes a shaft having an axis of rotation. The turbine engine further includes a plurality of blades coupled to the shaft. Additionally, the turbine engine includes a shroud having a plurality of segments disposed circumferentially about the plurality of blades. Each of the segments includes a fixed shroud portion having a first magnet and a movable shroud portion having a second magnet opposite from the first magnet. In each segment, at least one of the first or second magnets includes an electromagnet, wherein the movable shroud portion is magnetically actuated by the first and second magnets to move in a radial direction relative to the rotational axis of the shaft to vary a clearance between the plurality of blades and the movable shroud portion.

In another embodiment, a system includes an annular shroud. The annular shroud is configured to extend around a plurality of blades of a compressor or a turbine. The annular shroud includes a fixed shroud portion having a first electromagnet and a movable shroud portion having a second electromagnet. The movable shroud portion is magnetically actuated by the first and second electromagnets to move in a radial direction relative to a rotational axis of the blades to vary a clearance between the plurality of blades and the movable shroud portion.

In yet a further embodiment, a system includes a turbine clearance controller. The turbine clearance controller is configured to independently adjust clearances of a plurality of shroud segments about a plurality of blades via first and second magnets opposite from one another in fixed and movable portions of each shroud segment.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
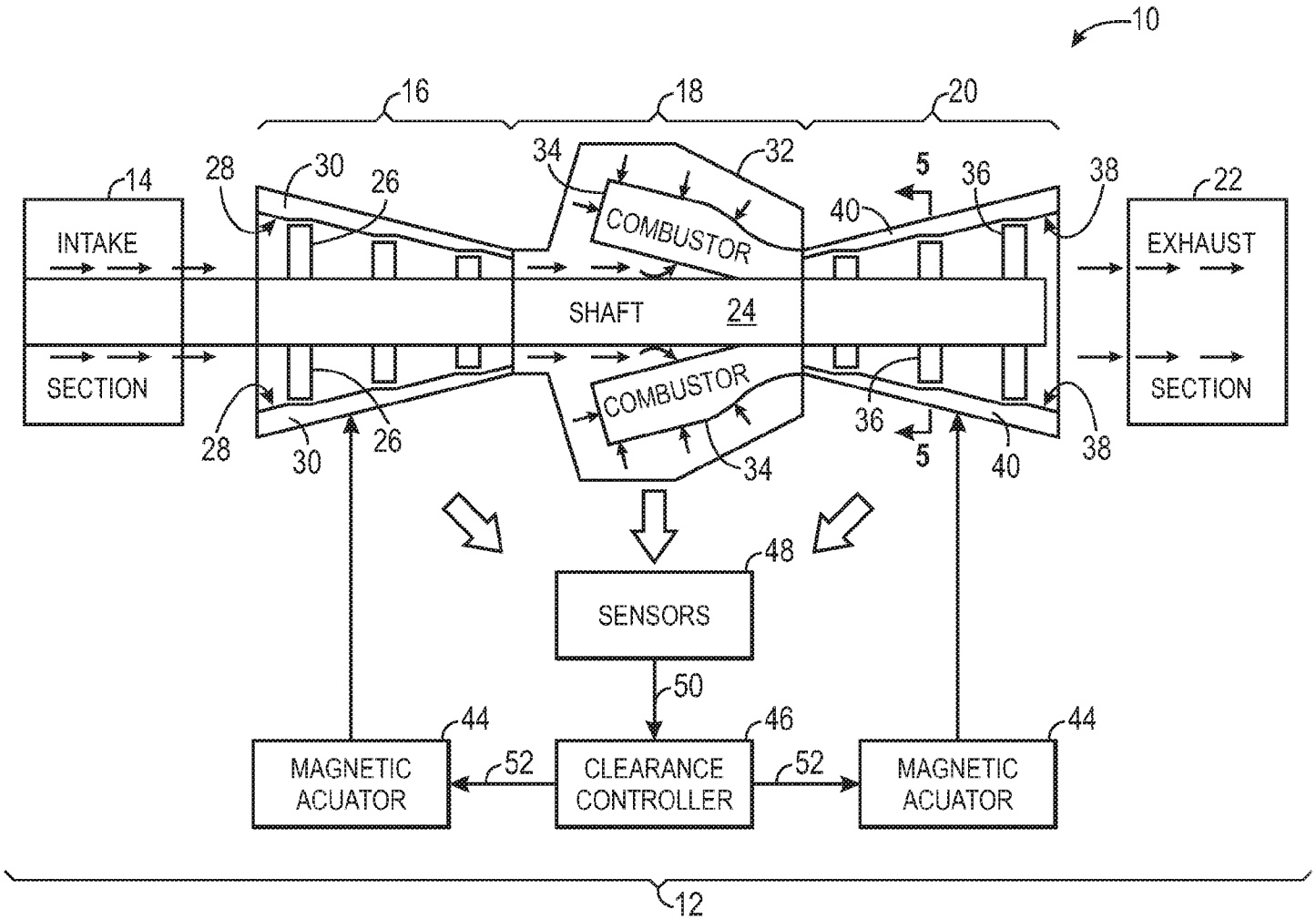
FIG. 1 is a simplified diagram illustrating a system that includes a gas turbine engine having a turbine that includes a magnetically-actuated clearance control system, in accordance with embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

As discussed in detail below, the present disclosure generally relates to magnetically controlled clearance techniques that may be implemented in a system, such as a turbine engine-based system (e.g., aircraft, locomotive, power generator, etc.). As used herein, the term "clearance" or the like shall be understood to refer to a spacing or gap that may exist between two or more components of the system that move relative to one another during operation. The clearance may correspond to an annular gap, a linear gap, a rectangular gap, or any other geometry depending on the system, type of movement, and other various factors, as will be appreciated by those skilled in the art. In one application, the clearance may refer to the radial gap or space between housing components surrounding one or more rotating blades of a compressor, a turbine, or the like. By controlling the clearance using the presently disclosed techniques, the amount of leakage between the rotating blades and the housing may be reduced to increase operational efficiency, while simultaneously minimizing the possibility of a rub (e.g., contact between housing components and the rotating blades). As will be appreciated, the leakage may correspond to any fluid, such as air, steam, combustion gases, and so forth.

In accordance with embodiments of the invention, a turbine engine utilizing the magnetic clearance control techniques disclosed herein may include a housing component having a stationary shroud portion and one or more movable shroud portions positioned circumferentially about a rotational axis of the turbine engine to define an inner surface of the housing. Each of one or more magnetic actuating elements may provide radial movement of a respective one of the movable shroud portions in response to control signals provided by a clearance controller. In one embodiment, each movable shroud portion (by way of its corresponding magnetic actuating element) may be actuated independently to provide for varying radial displacements for each movable shroud portion. In this manner, a substantially consistent clearance with respect to rotating turbine blades (or compressor blades) may be maintained about the inner surface of the housing, even if the turbine housing itself is out-of-round, or becomes out-of-round during operation (e.g., due to deformation caused by uneven thermal expansion, etc.). Further, in some embodiments, the radial positions of the movable shroud portions may be adjusted in real-time depending on one or more operating conditions of the turbine engine. Such operating conditions may be measured by sensors, such as temperature sensors, vibration sensors, position sensors, etc. By providing real-time adjustment of the moveable shroud portions, the clearance between the turbine housing and the turbine blades (or compressor blades) may be finely adjusted to balance the turbine efficiency against the possibility of contact (e.g., a rub) between the turbine blades and the turbine housing. In some embodiments, the adjustment of the moveable shroud portions may be determined based at least partially upon a current operating condition of the turbine, i.e., start-up, steady-state, full-speed full-load, turndown, etc.

With the foregoing in mind, FIG. 1 is a block diagram of an exemplary system 10 that includes a gas turbine engine 12 having magnetic clearance control features in accordance with embodiments of the present technique. In certain embodiments, the system 10 may include an aircraft, a watercraft, a locomotive vehicle, a power generation system, or some combination thereof. Accordingly, the turbine engine 12 may drive a variety of loads, such as a generator, a propeller, a transmission, a drive system, or a combination thereof. The turbine system 10 may use liquid or gas fuel, such as natural gas and/or a hydrogen rich synthetic gas, to run the turbine system 10. The turbine engine 12 includes an air intake section 14, a compressor 16, a combustor section 18, a turbine 20, and an exhaust section 22. As shown in FIG. 1, the turbine 20 may be drivingly coupled to the compressor 16 via a shaft 24.

In operation, air enters the turbine system 10 through the air intake section 14 (indicated by the arrows) and may be pressurized in the compressor 16. The compressor 16 may include compressor blades 26 coupled to the shaft 24. The compressor blades 26 may span the radial gap between the shaft 24 and an inner wall or surface 28 of a compressor housing 30 in which the compressor blades 26 are disposed. By way of example, the inner wall 28 may be generally annular or conical in shape. The rotation of the shaft 24 causes rotation of the compressor blades 26, thereby drawing air into the compressor 16 and compressing the air prior to entry into the combustor section 18. As such, it is generally desirable to maintain a small radial gap between the compressor blades 26 and the inner wall 28 of the compressor housing 30 in order to prevent contact between the compressor blades 26 and the inside surface 28 of the compressor housing 30. For instance, contact between the compressor blade 26 and the compressor housing 30 may result in an undesirable condition generally referred to "rubbing" and may cause damage to one or more components of the turbine engine 12.

The combustor section 18 includes a combustor housing 32 disposed concentrically or annularly about the shaft 24 and axially between the compressor section 16 and the turbine 20. Within combustor housing 32, the combustor section 20 may include a plurality of combustors 34 disposed at multiple circumferential positions in a generally circular or annular configuration about the shaft 24. As compressed air exits the compressor 16 and enters each of the combustors 34, the compressed air may be mixed with fuel for combustion within each respective combustor 34. For example, each combustor 34 may include one or more fuel nozzles that may inject a fuel-air mixture into the combustor 34 in a suitable ratio for optimal combustion, emissions, fuel consumption, and power output. The combustion of the air and fuel may generate hot pressurized exhaust gases, which may then be utilized to drive one or more turbine blades 36 within the turbine 20.

The turbine 20 may include the above-mentioned turbine blades 36, and a turbine housing 40. The turbine blades 36 may be coupled to the shaft 24 and span the radial gap between the shaft 24 and the inside or inner wall 38 of turbine housing 40. By way of example, the inner wall 38 may be generally annular or conical in shape. The turbine blades 36 are generally separated from the inner wall 38 of the turbine housing 40 by a small radial gap to prevent the occurrence of contact (or a rub) between the turbine blades 36 and the inner wall 38 of the turbine housing 40. As will be appreciated, contact between the turbine blade 36 and the turbine housing 40 may result in rubbing, as discussed above, which may cause damage to one or more components of the turbine engine 12.

The turbine 20 may include a rotor element that couples each of the turbine blades 36 to the shaft 24. Additionally, the turbine 20 depicted in the present embodiment includes three stages, each stage being represented by a respective one of the illustrated turbine blades 36. It should be appreciated, however, that other configurations may include more or fewer turbine stages. In operation, the combustion gases flowing into and through the turbine 20 flow against and between the turbine blades 36, thereby driving the turbine blades 36 and, thus, the shaft 24 into rotation to drive a load. The rotation of the shaft 24 also causes the blades 26 within the compressor 16 to draw in and pressurize the air received by the intake 14. Further, in some embodiments, the exhaust exiting the exhaust section 22 may be used as a source of thrust for a vehicle such as a jet plane, for example.

As further shown in FIG. 1, the turbine system 10 may include a clearance control system. The clearance control system may include several magnetic actuating elements 44, a clearance controller 46, and various sensors 48 disposed at various locations about the turbine system 10. The magnetic actuators 44 may be used to position a radially movable portion of the compressor housing 30 or the turbine housing 40, according to signals 52 received from the clearance controller 46. The clearance controller 46 may include various hardware and/or software components programmed to execute routines and algorithms for adjusting the clearance (e.g., a radial gap) between the turbine blades 36 and the turbine housing 40 and/or between the compressor blades 26 and the compressor housing 30. The sensors 48 may be used to communicate various data 50 about the operating conditions of the turbine engine 12 to the clearance controller 46 so that the clearance controller 46 may adjust the magnetic actuators 44 accordingly. By way of example only, the sensors 48 may include temperature sensors for sensing a temperature, vibration sensors for sensing vibration, flow sensors for sensing a flow rate, positional sensors, or any other sensors suitable for detecting various operating conditions of the turbine 12, such as a rotational speed of the shaft 24, power output, etc. The sensors 48 may be positioned at/in any component of the turbine system 10, including the intake 14, compressor 16, combustor 18, turbine 20, and/or exhaust section 20, etc. As will be appreciated, by minimizing the blade clearance in this manner during operation of the turbine engine 12, more of the power created via the combustion of fuel in the combustor section 18 may be captured by the turbine 20.

Figure 2:
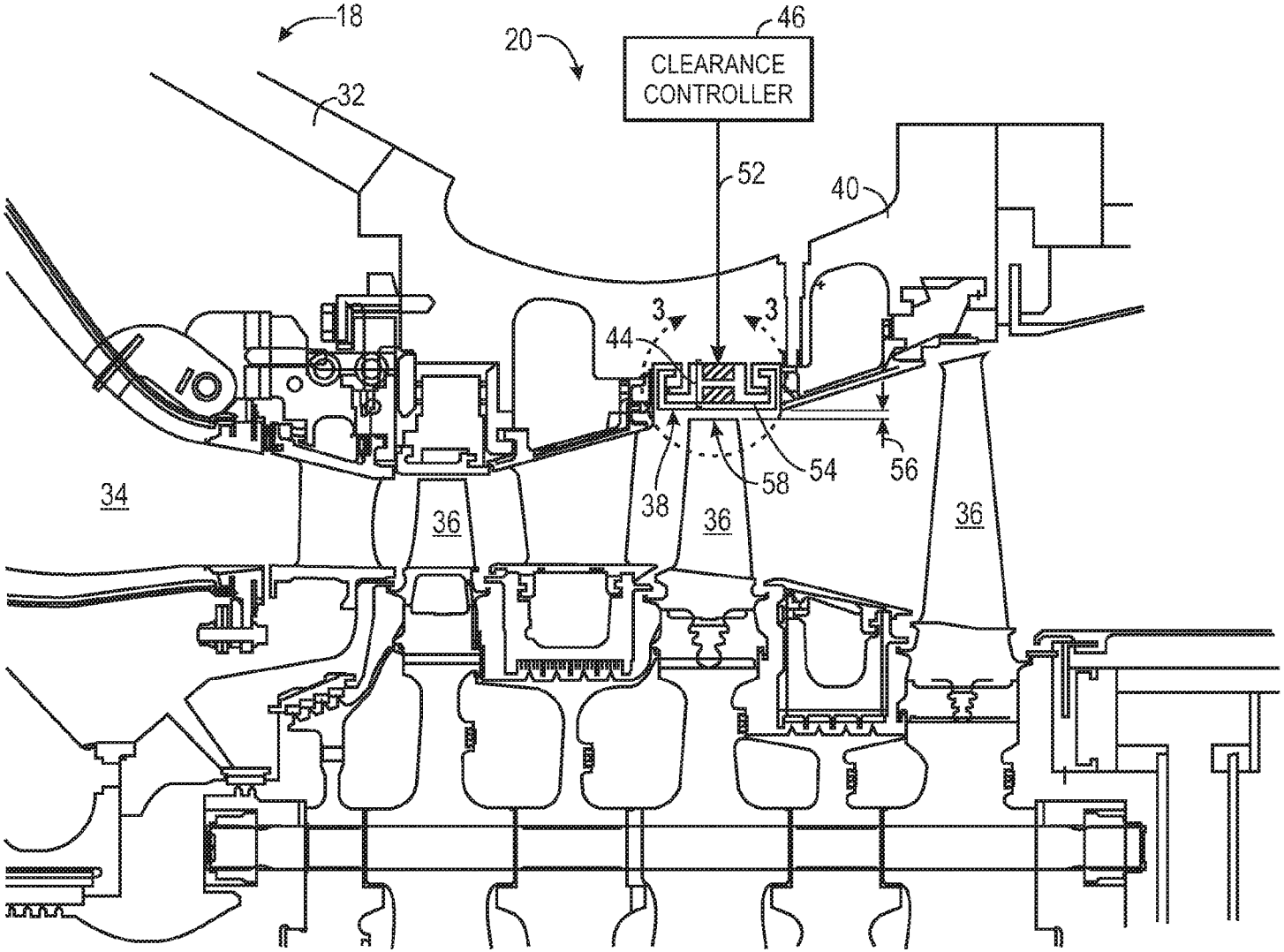
FIG. 2 is a partial axial cross-section of the turbine of FIG. 1, illustrating an embodiment of a magnetically actuated element of the clearance control system of FIG. 1.

The clearance control techniques described herein may be better understood with reference to FIG. 2, which shows a partial axial cross-section of the turbine section 20 of FIG. 1. As shown in FIG. 2, the turbine housing 40 may include a movable shroud portion 54 that defines the above-referenced inner surface or wall 38 of the turbine housing 40. As mentioned above, the clearance between the turbine blade 36 and the inner wall 38 of the movable shroud portion 54 may be defined by a radial gap 56 spanning the distance between the inner surface or wall 38 of the movable shroud portion 54 and the tip 58 of the blade 36. This clearance or radial gap 56 prevents contact between the turbine blades 36 and the turbine housing 40 and also provides a path for combustion gases to bypass the turbine blades 36 as the combustion gases flow downstream along the axial direction, i.e., towards the exhaust section 22. As can be appreciated, gas bypass is generally undesirable because energy from the bypassing gas is not captured by the turbine blades 36 and translated into rotational energy, thus reducing the efficiency and power output of the turbine engine 12. In other words, turbine system efficiency is at least partially dependent on the quantity of combustions gases captured by the turbine blades 36. Thus, by reducing the radial gap 56, the power output from the turbine 20 may be increased. However, as mentioned above, if the radial gap 56 is too small, rubbing may occur between the turbine blades 36 and the turbine housing 40, resulting in possible damage to components of the turbine engine 12.

To provide a suitable balance between increasing the efficiency of the turbine 20 and decreasing the possibility of contact or rubbing between the turbine blades 36 and the turbine housing 40, the magnetic actuating elements 44 may be utilized for moving the movable shroud portion 54 in a radial direction towards or away from the rotational axis (e.g., axis along shaft 24) of the turbine 20 to increase or decrease the size of radial gap 56. In the presently illustrated embodiment, the movable shroud portion 54 is shown as being coupled directly to the turbine housing 40. In other embodiments, an intermediate shroud segment may be intermediately coupled between the housing 40 and the movable shroud portion 54. In other words, the movable shroud portion 54 may be coupled to an intermediate shroud segment, and the intermediate shroud segment may be coupled to the turbine housing 40. Thus, depending on the particular configuration of the turbine section 20, a generally annular-shaped shroud structure that surrounds the turbine blades 36 may include the movable shroud portions 54 and the turbine housing 40, or may include the movable shroud portions 54, intermediate shroud portions, and the turbine housing 40.

Figure 3:
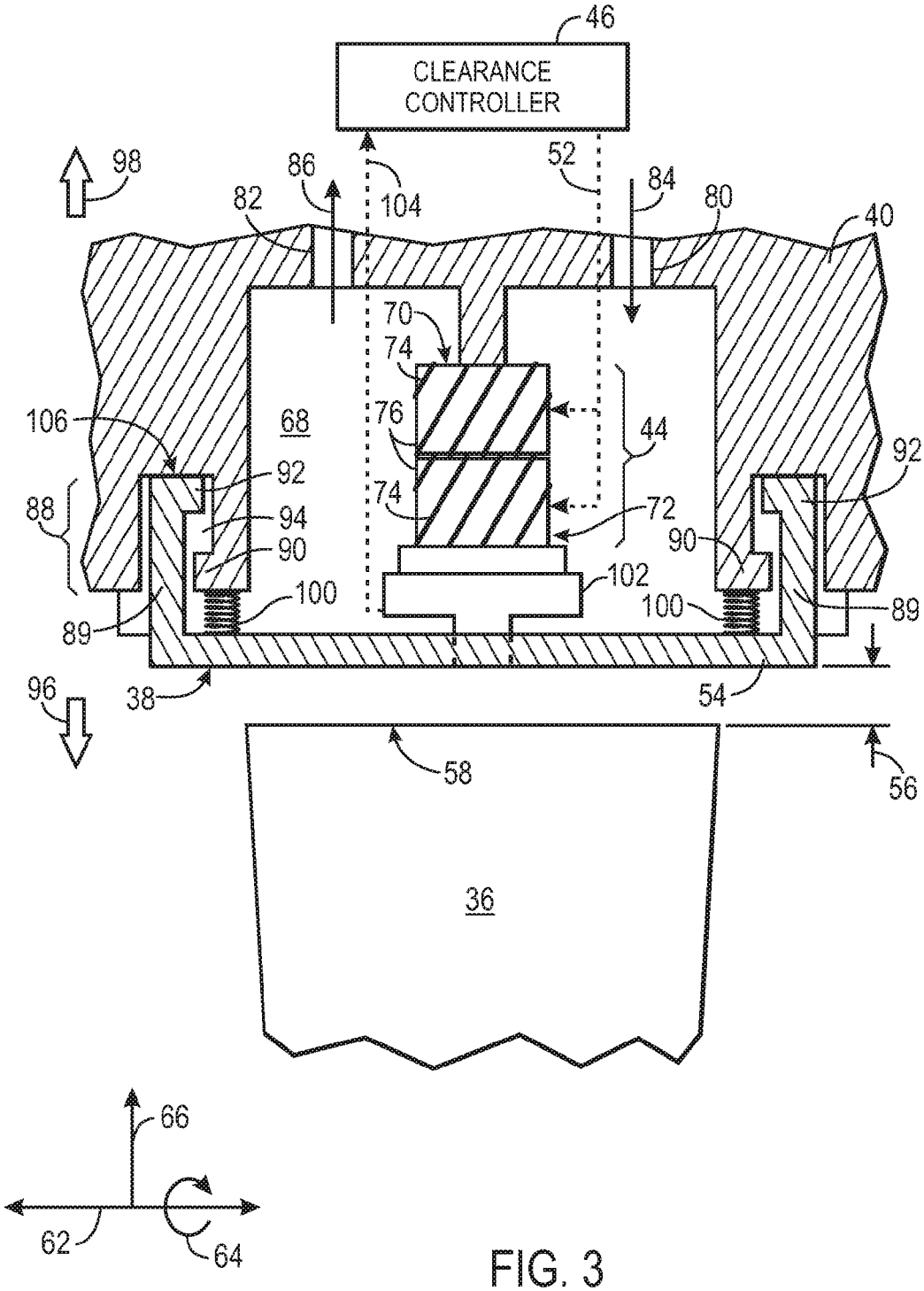
FIG. 3 is a close-up axial cross-section showing the magnetically actuated element taken within arcuate line 3-3 of FIG. 2 in a first radial position.

As will be more clearly illustrated in FIG. 3, the magnetic actuator 44, in one embodiment, may be positioned between the turbine housing 40 and the movable shroud portion 54. Furthermore, it will be appreciated that the shroud adjustment techniques shown in FIG. 2 may be employed in relation to any one or several of the illustrated turbine blades 36. For instance, in a multi-stage turbine, the shroud adjustment techniques may provide for a movable shroud portions 54 in each stage. Additionally, it should be understood that the shroud adjustment techniques discussed herein may also be used in a similar manner for controlling clearance with regard to the compressor blades 26 within the compressor housing 30.

Referring now to FIG. 3, a close-up view of the movable shroud elements illustrated within the region defined by the arcuate line 3-3 of FIG. 2 is shown. For clarity, the rotational axis of the turbine 20 is shown via the arrow 62, the rotational direction of the turbine blades 36 is shown via arrow 64, and the radial direction is shown via arrow 66. As is more clearly shown in FIG. 3, the magnetic actuating element 44 is located inside a cavity 68 between the turbine housing 40 and the movable shroud portion 54. Specifically, the magnetic actuator 44 may include a first magnet 70 and a second magnet 72. The first magnet 70 (hereinafter the "stationary magnet") may be coupled to the turbine housing 40 and remains stationary with respect to the housing 40 during operation of the magnetic actuator 44. The second magnet 72 (hereinafter the "movable magnet") may be coupled to the movable shroud portion 54 and may move in relation to the housing 40 during operation.

In the illustrated embodiment, the polarity of the magnets 70 and 72 may be aligned to provide a repelling force between the stationary magnet 70 and the movable magnet 72. In some embodiments, one or both of the stationary magnet 70 and the movable magnet 72 may be electromagnets. For instance, as shown in FIG. 3, each of the magnets 70 and 72 may include a coil of wire 74 that is wound around a magnetic core 76 and electrically coupled to the clearance controller 46. The coil 74 may include any suitable conductor, such as copper, and the core 76 may include any suitable magnetic core material, such as iron, for instance. Additionally, in other embodiments, the magnets 70 and 72 may include horse-shoe magnets or solenoids. As will be understood, the orientation of the magnets 70 and 72 will depend on the type of magnetic elements used.

In some embodiments, heat from the combustion gases flowing through the turbine 20 may result in a high temperature within the cavity 68. For instance, during operation of the turbine engine 12, the temperature within the cavity 68 may reach approximately 800 to 1700 degrees Fahrenheit or more. Accordingly, the coil 74 and the core 76 corresponding to each of the stationary magnet 70 and the movable magnet 72 may include materials that are stable and exhibit suitable electrical properties at high temperatures. By way of example only, in some embodiments, the coil 74 may include nickel, and the core 76 may include an iron/cobalt/vanadium alloy, such as Vacoflux50® (approximately 49.0% cobalt, 1.9% vanadium, and 49.1% iron), available from Vacuumschmelze GmbH of Hanau, Hesse, Germany, or Hiperco50® (approximately 48.75% cobalt, 1.9% vanadium, 0.01% carbon, 0.05% silicon, 0.05% columbium/niobium, 0.05% manganese, and 49.19% iron), available from Carpenter Technology Corporation of Wyomissing, Pa., USA. Additionally, to reduce temperatures within the cavity 68, the housing 40 may include vents 80 and 82 that provide a flow path for a cooling fluid to circulate through the cavity 68, as indicated by the flow arrows 84 and 86. In one embodiment, the cooling fluid may be a portion of air siphoned from the compressor 16.

As further shown in FIG. 3, the movable shroud portion 54 may be operatively coupled to the housing 40 by one or more grooves 88. For instance, the grooves 88 in the housing 40 may include a flange 90 that engages a corresponding flange 92 coupled to a track or rail 89 on the movable shroud portion 54. The grooves 88 and the rails 89 may be oriented in a circumferential direction relative to axis 62. For example, the groove 88 may extend circumferentially through the housing 40 and may allow the rail 89 (including flange 92) of the movable shroud portion 54 to slide into the groove 88 during assembly. Thus, with the rail 89 of the movable shroud portion 54 inserted into the groove 88, a cavity 94 inside the groove 88 allows the movable shroud portion 54 to move radially (along the radial axis 66) towards the rotational axis 62 (arrow 96) to decrease the gap distance 56 (e.g., decrease clearance) or move radially (along the radial axis 66) away from the rotational axis 62 (arrow 98) to increase the gap distance 56 (e.g., increase clearance). By way of example, the movable shroud portion 54, in some embodiments, may have a range of motion of at least less than approximately 25, 50, 75, 100, 125, or 150 millimeters. In other embodiments, the movable shroud portion 54 may have a range of motion of less than 25 millimeters or greater than 150 millimeters. Further, as illustrated in FIG. 3, separate grooves 88 may be disposed on each opposite axial end of the cavity 68 to receive flanges 92 extending rails 89 coupled to opposite axial ends of the movable shroud portion 54. That is, each movable shroud portion 54 may be coupled to a pair of rails 89 oriented circumferentially with respect to axis 62 and configured to couple the movable shroud portion 54 to the grooves 88 on the housing 40.

In the illustrated embodiment, the movable shroud portion 54 may further be coupled to the housing 40 by one or more biasing members, depicted here as springs and referred to by reference number 100. The springs 100 may normally bias the movable shroud portion 54 radially away, i.e., in the direction 98, from the rotational axis 62 of the turbine 20. In this manner, a failsafe mechanism is provided, wherein the movable shroud portion 54 will be moved radially away from the rotational axis 62, thereby increasing the clearance (e.g., the gap distance 56) between the inner wall 38 of the turbine housing 40 and the turbine blades 36, if the magnets 70 and 72 become inoperative (e.g., due to electrical or mechanical failure or malfunctions). As will be appreciated, the spring (s)/biasing members 100 may be located at any suitable location between the turbine housing 40 and the movable shroud portion 54.

The movable shroud portion 54 may be coupled to a clearance or proximity sensor 102 configured to detect clearance, i.e. the gap distance 56, by measuring a distance between the bottom surface 38 of the movable shroud portion 54 and the tip 58 of the blade 36. As will be appreciated, the sensor 102 may be any suitable type of proximity sensor, including capacitive, inductive, or photoelectric proximity sensors. An output 104 from the proximity sensor 102 may be sent to the clearance controller 46 as a feedback signal. Thus, by using the clearance data 104 provided by the proximity sensors 102 and/or feedback data 50 (e.g., temperature, vibration, flow, etc.) provided by other turbine sensors 48, as discussed above, the clearance controller 46 may adjust the radial gap 56 between the inner wall 38 of the turbine housing 40 and the tip 58 of the turbine blades 36 accordingly.

Before continuing, it should be noted that the above-described features of FIG. 3 may also be provided in embodiments that include an intermediate shroud segment or portion, as discussed above with reference to FIG. 2 (e.g., intermediately coupled between the movable shroud portion 54 and the turbine housing 40). For instance, in such embodiments, the stationary magnet 70 is coupled to the intermediate shroud portion, and the grooves 88 are also formed on the intermediate shroud portion (e.g., instead of the turbine housing 40). The rails 89 on the movable shroud portion 54 may couple to grooves 88 on the intermediate shroud portions. In other words, the movable shroud portion 54 may also assemble on the intermediate shroud portion. Regardless of the configuration used, the operation of the magnetic actuating elements (e.g., stationary magnet 70 and movable magnet 72) is generally the same, as will be discussed below.

Figure 4:
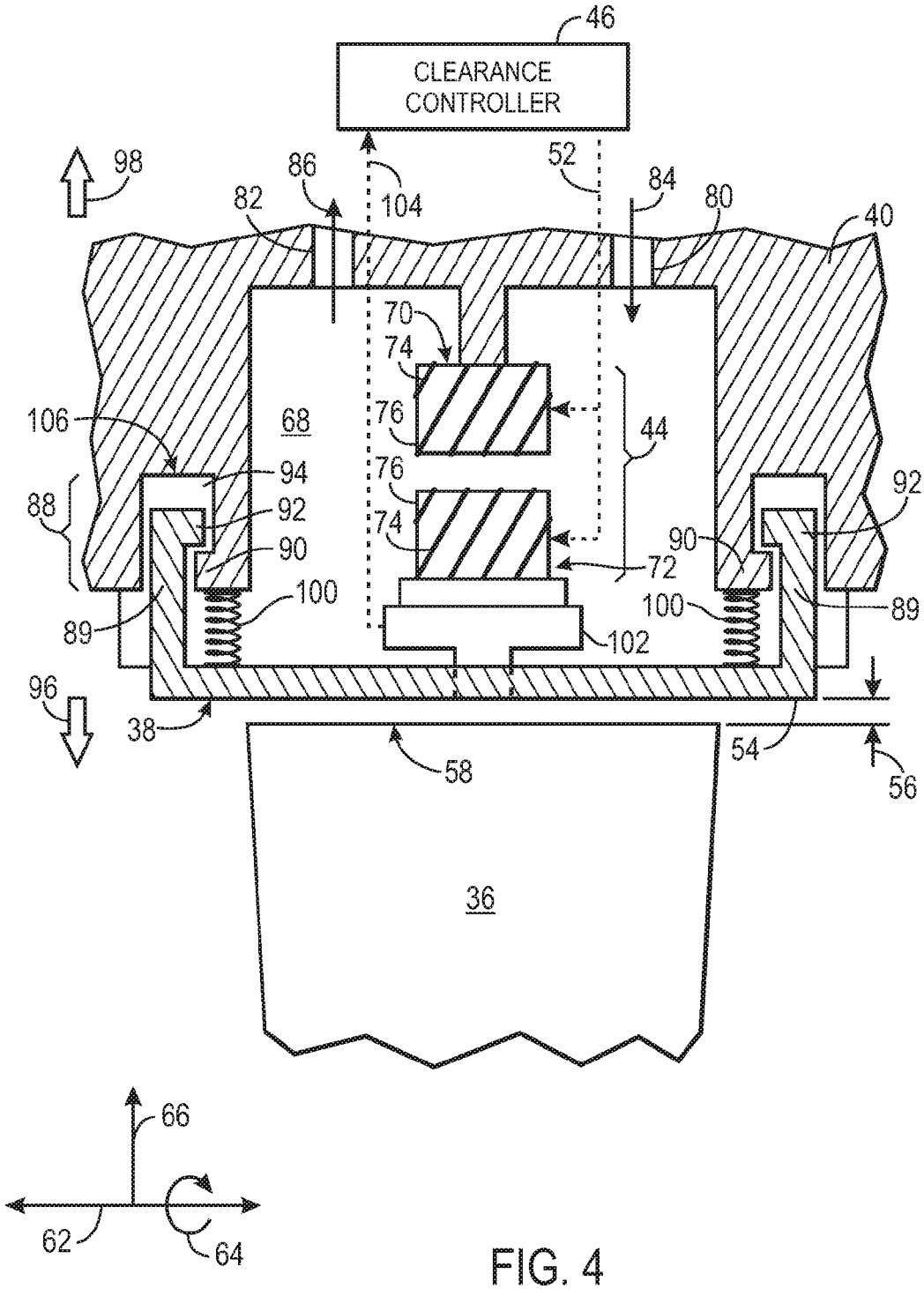
FIG. 4 is a close-up axial cross-section showing the magnetically actuated element taken within arcuate line 3-3 of FIG. 2, but in a second radial position.

Referring now to FIG. 4, the operation of the magnetic actuator 44 is illustrated in further detail. In operation, the clearance controller 46 may decrease the radial gap 56 by providing appropriate control signals 52 in the form of a current to the coils 74. As will be appreciated, as current flows into the coils 74 a magnetic field is generated. Depending on the configuration of the magnets 70 and 72, the current supplied to each magnet 70 and 72 may be the same or of different values. The magnetic field creates a repulsive force between the stationary magnet 70 and the movable magnet 72 that counteracts the biasing force of the spring(s) 100 and causes the movable shroud 54 to move radially towards the rotational axis 62 (e.g., in the direction of arrow 96). The clearance controller 46 may increase the radial gap distance 56 by reducing or eliminating the current supplied to the coils 74 such that the biasing force of the spring(s) 100 causes the movable shroud portion 54 to move outward and away (e.g., in the direction of arrow 98) from the rotational axis 62. For instance, the movable shroud portion 54 may continue to move in the direction of arrow 98 until it returns to the position shown in FIG. 3. In this manner, the clearance controller 46 may finely adjust the position of the movable shroud portion 54 and, thus, the clearance between the turbine blades 36 and the turbine housing 40, by adjusting the strength of the generated magnetic field(s). Furthermore, with the arrangement described above, it may be possible to actively adjust the radial gap 56 in real-time according to sensed clearance information 104 and/or based upon one or more operating conditions of the turbine engine 12. Such techniques for adjusting the radial gap 56 will be discussed further below with reference to FIGS. 7 and 8.

Figure 5:
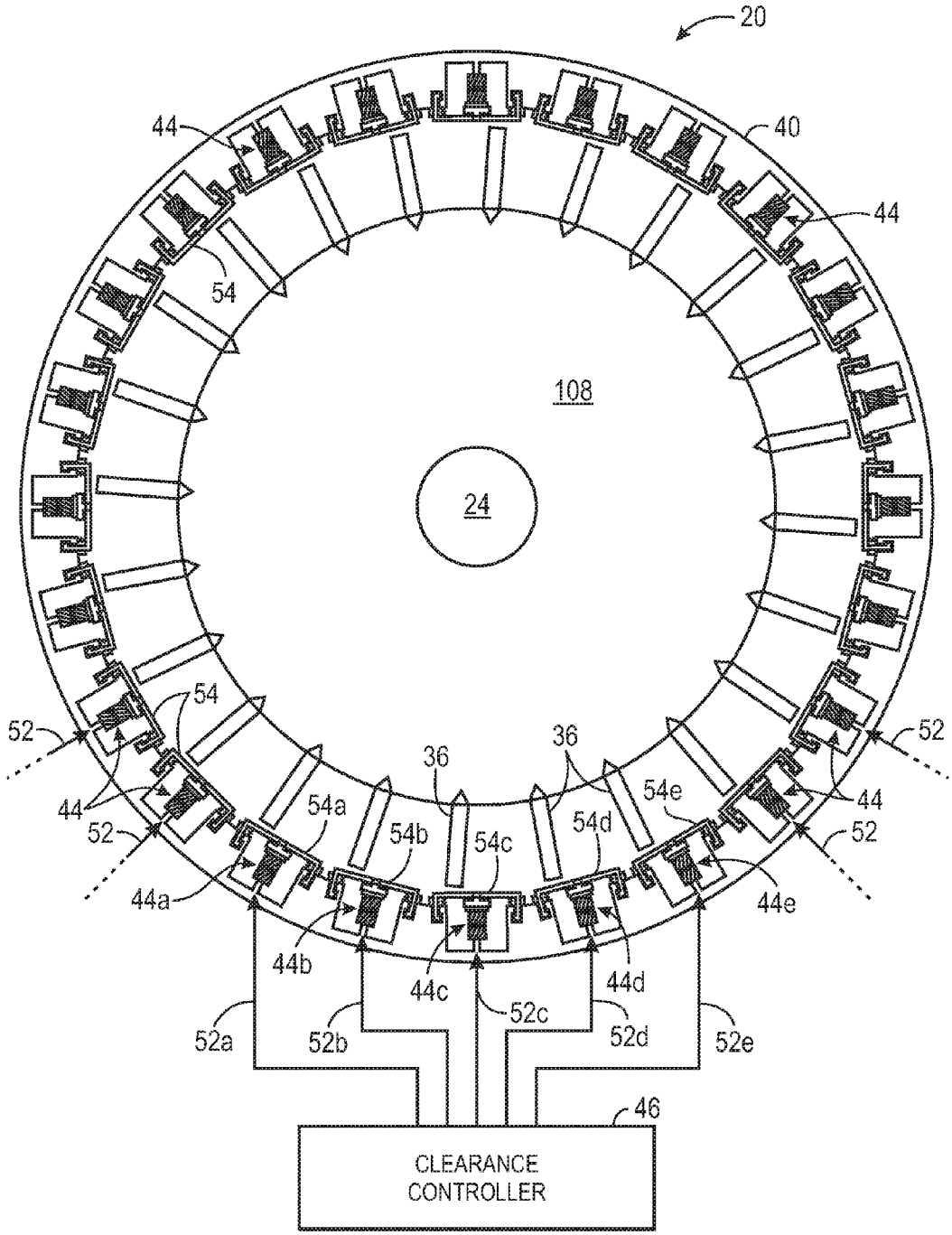
FIG. 5 is a partial radial cross-section of the turbine of FIG. 1, in accordance with an embodiment of the present technique.

Turning to FIG. 5, a cross-sectional view of the turbine 20 of FIG. 1 is illustrated along cut-line 5-5 of FIG. 1. As shown, a plurality of turbine blades 36 may be coupled to a rotor 108 which, in turn, may be coupled about the shaft 24. As combustion gases flow through the turbine 20, the blades 36 cause the rotor 108 to rotate, thereby also causing the shaft 24 to rotate. As is more clearly shown in FIG. 5, the turbine housing 40 may include a plurality of segments, each including a movable shroud portion 54 distributed circumferentially about the turbine housing 40 and generally surrounding the turbine blades 36. Each movable shroud portion 54 may include a magnetic actuator 44, which may be independently controlled by a respective one of a plurality of control signals 52 provided by the clearance controller 46. For instance, the turbine housing 40 may include the movable shroud portions

54*a*-54*e*, each of which may include respective magnetic actuating components 44*a*-44*e*. In response to respective control signals 52*a*-52*e*, each of the movable shroud portions 54*a*-54*e* may be positioned by the clearance controller 46 as appropriate to maintain a desired clearance and circularity in the flow path between the movable shroud portion 54 and the turbine blades 36.

While only the movable shroud portions 54*a*-54*e* are specifically referenced in FIG. 5 for illustrative purposes, it should be appreciated that the clearance controller 46 may be configured to send an independent respective control signal 52 to each movable shroud portion 54 within the housing for actuation of a corresponding magnetic actuator 44. For example, in one embodiment, each movable shroud portion 54 may include a separate sensor 102 for measuring clearance, as discussed above. Thus, each magnetic actuator 44 and each sensor 102 may be communicatively coupled to the clearance controller 46, and each movable shroud portion may be adjusted based at least partially on clearance data provided to the clearance controller 46 by the sensors 102. In other words, the clearance controller 46 may provide for the independent control of each movable shroud portion 54 by actuating (or de-actuating) a respective magnetic actuator 44 (including magnets 70 and 72) corresponding to a respective one of the movable shroud portions 54 based at least partially on clearance feedback data (output 104) from a respective clearance sensor 102 on each movable shroud portion 54 (e.g., as shown in FIGS. 3 and 4). Additionally, it should be understood that the movable shroud portions 54 are illustrated in FIG. 5 as having a slight spacing between each other in the circumferential direction (relative to axis 62) for purposes of clarity. In some embodiments, this spacing may be substantially reduced or eliminated to further improve turbine performance.

As shown in FIG. 5, the turbine housing 40 may include 24 movable shroud portions 54. It will be appreciated, however, that any suitable number of movable shroud portions 54 may be provided. For example, the turbine housing 40 may include 10, 20, 30, 40, 50 or more movable shroud portions 54. Together, the movable shroud portions 54 may be actuated so that the totality of the inner surfaces 38 provides a substantially circular surface about the turbine blades 36. In some embodiments, the inner surfaces 38 of the movable shroud portions 54 may be curved in the circumferential direction to improve the overall circularity of the shroud. Further, by providing individual control of each movable shroud portions 54, as discussed above, the circularity of the shroud may be improved during conditions in which the turbine housing 40 becomes out-of-round due, for example, due to uneven thermal expansion of the turbine housing 40 during operation. This out-of-roundness condition will be depicted more clearly in FIG. 6.

Figure 6:
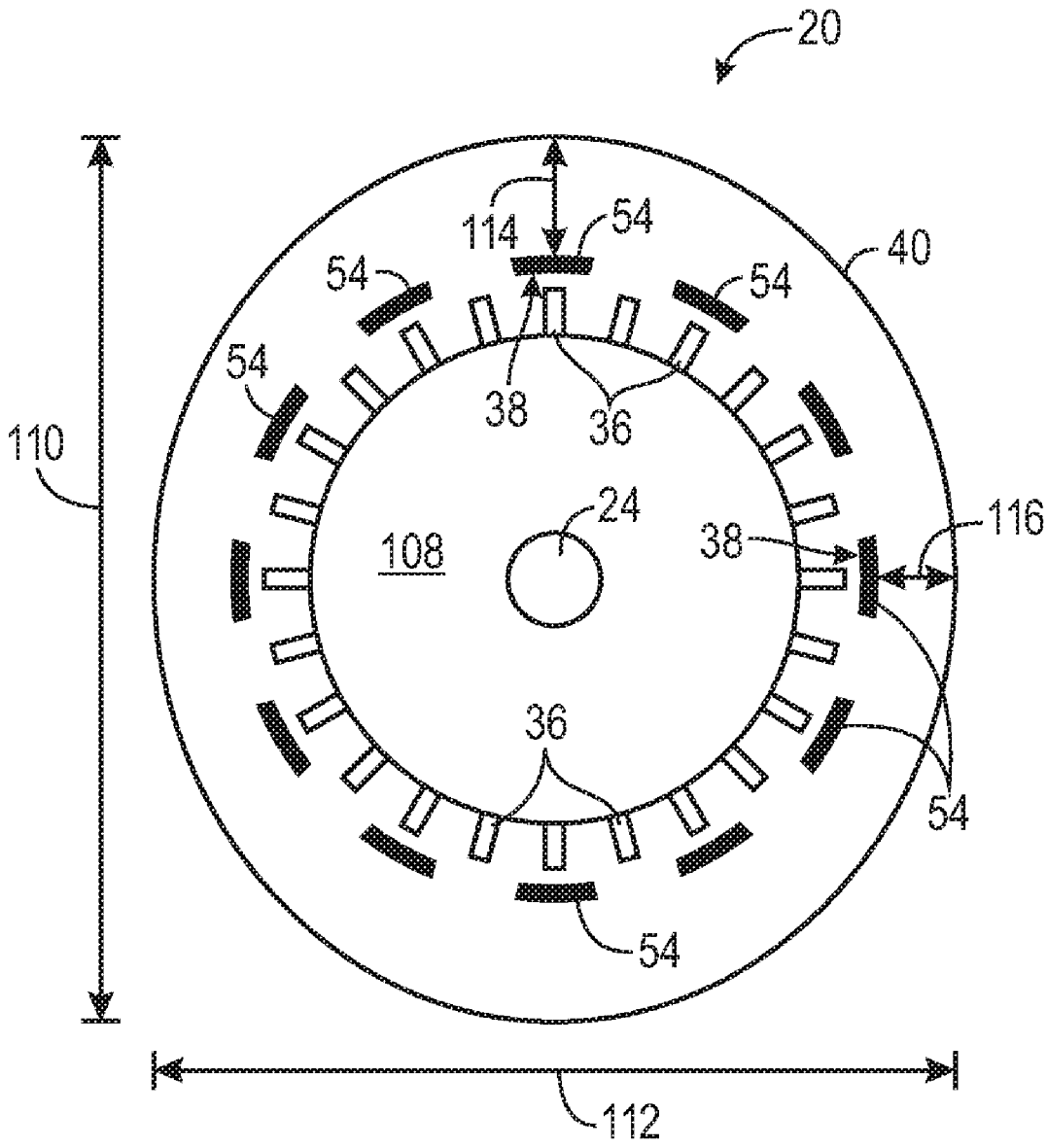
FIG. 6 is a simplified partial radial cross-section of the turbine of FIG. 1 that illustrates deformation of the turbine due to thermal expansion, in accordance with an embodiment of the present technique.

Turning to FIG. 6, a simplified cross-sectional view of the turbine 20 along cut-line 5-5 of FIG. 1 is shown that demonstrates the improved circularity of the shroud (e.g., defined by the inner wall 38 of the movable shroud portions 54) when the turbine housing 40 is out-of-round. It will be appreciated that the shape of the turbine housing 40 is exaggerated in FIG. 6 in order to more clearly depict the deformation of the turbine housing 40. The deformation of the turbine housing 40 may be due to the fact that, in some embodiments, the turbine housing 40 may be split at a plane passing through the shaft 24 centerline (e.g., the rotational axis 62) to enable better access to the internal components of the turbine 20, for example, during service and maintenance. In such a configuration, a horizontal joint may be used to mate the two pieces of the turbine housing 40. By way of example, the joint may include two mating flanges with through-bolts that provide clamping pressure between the flanges, thus coupling the pieces of the turbine housing 40 together. However, the additional radial thickness due to the presence of the flanges may result in a thermal response in the general proximity of the flanges that differs from the rest of the turbine housing 40, as well as a discontinuity in circumferential stresses that may develop during operation of the turbine 20. The combined effect of the thermal response and stress discontinuity at the flange joints may cause the turbine housing 40 to become out-of-round during the operation of the turbine 20.

For instance, as shown in FIG. 6, the height 110 of the turbine housing 40 may tend to be greater than the width 112 of the turbine housing 40 when the turbine 20 exhibits out-of-roundness after operating for a sufficient period of time. Furthermore, in some cases, the exaggerated non-circularity of the turbine housing 40 may resemble a football or peanut shape. In some embodiments, the non-circularity of the turbine housing 40 with regard to the difference between the height 110 and the width 112 may be up to approximately 100 millimeters or more. Despite the non-circularity of the turbine housing 40, however, the inner wall or surfaces 38 of the movable shroud portions 54 may maintain a substantially circular cross section due to unequal actuation of the movable shroud portions 54 in such a way that the non-circularity of the turbine housing 40 is compensated. For example, as shown in FIG. 6, some of the movable shroud portions 54 (e.g., those actuated the distance 114) may be actuated to a greater degree than other movable shroud portions 54 (e.g., those actuated the distance 116). That is, due to the out-of-roundness condition of the turbine housing 40, some of the movable shroud portions 54 may move a greater displacement in order to maintain a desired clearance or radial gap 56 between the turbine blades 36 and the inner wall 38 of the movable shroud portions 54. In this manner, a suitable clearance may be maintained about the entire circumference of the turbine 20 despite possible non-circularity of the turbine housing 40.

Figure 7:
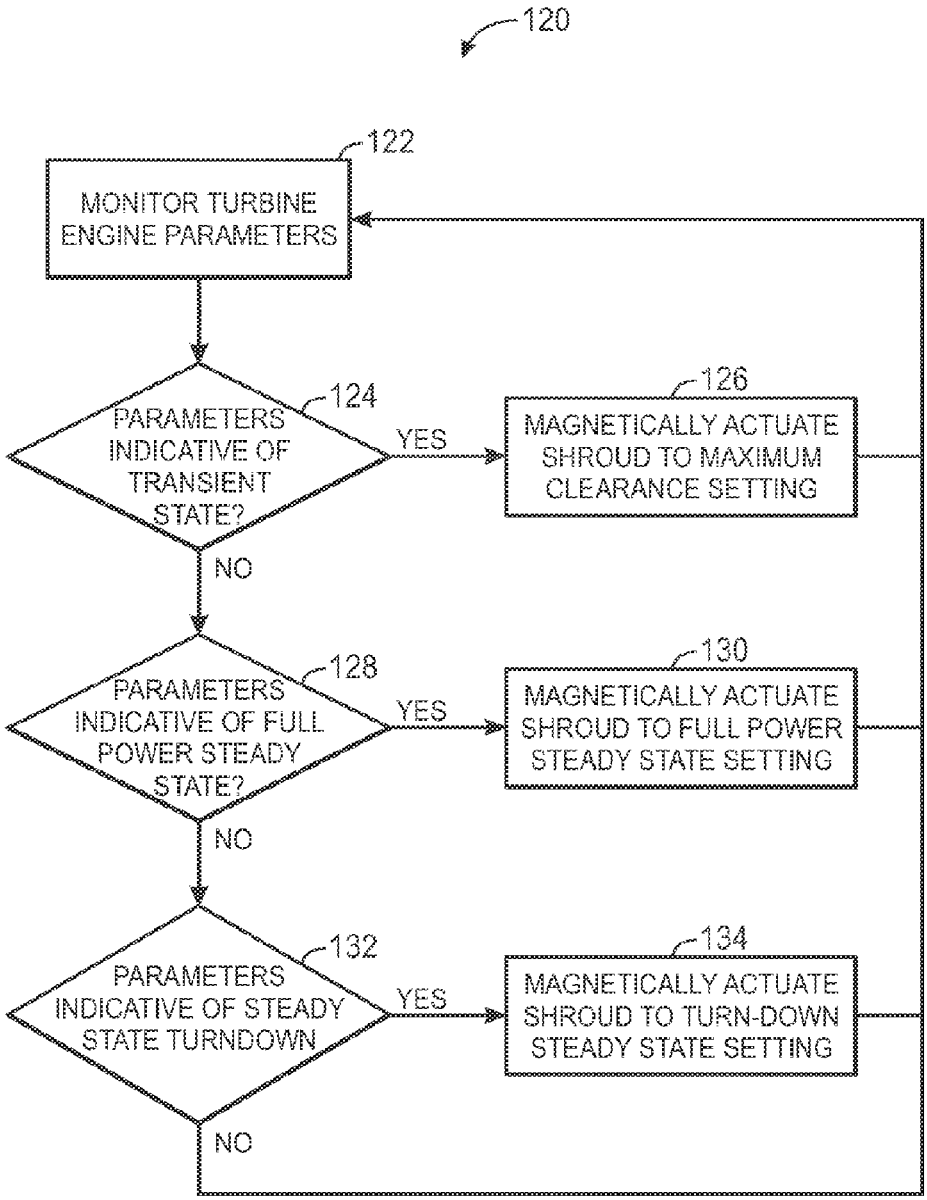
FIG. 7 is a flow chart depicting a method for adjusting a clearance setting based upon an operating condition of a turbine system, in accordance with an embodiment of the present technique.
Figure 8:
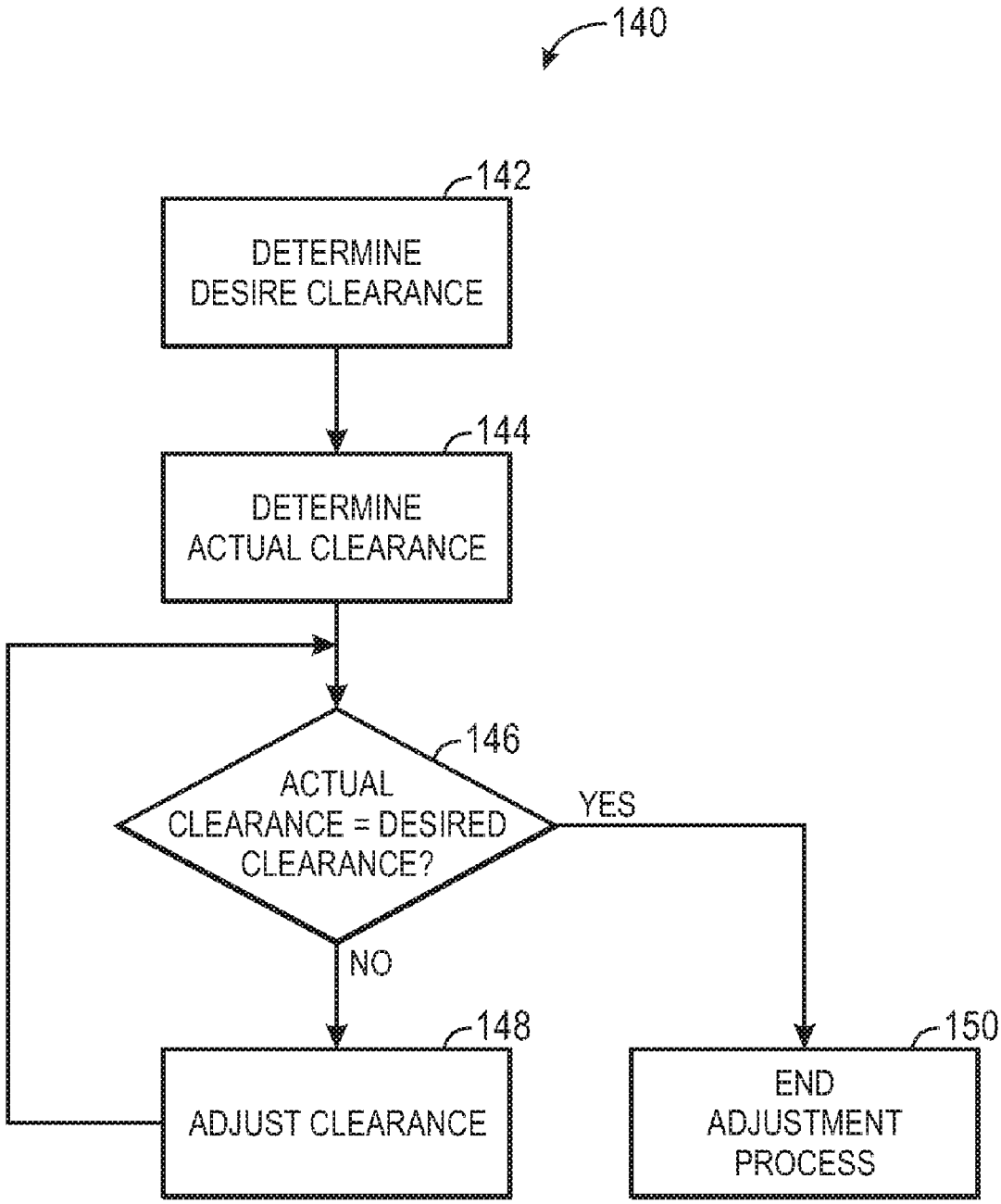
FIG. 8 is a flow chart depicting a method for adjusting a clearance setting based upon, at least in part, an evaluation of an actual and desired clearance, in accordance with an embodiment of the present technique.

Continuing now to FIGS. 7 and 8, examples of methods that may be used to adjust clearance in the system 10 are illustrated, in accordance with embodiments of the present technique. Referring first to FIG. 7, a method 120 for adjusting clearance based on measured parameters of the turbine engine 12 is shown. The method 120 may begin by monitoring one or more parameters of the turbine engine 12, as indicated at block 122. The parameters may be measured by the turbine sensors 48 discussed above and may be related to any suitable parameter of the turbine engine 12 that may be used to determine an appropriate clearance. For example, some parameters may relate to the temperature within the turbine 20 or of certain components of the turbine 20 (e.g., blades 36, rotor 108, etc.), vibration levels in the turbine 20, the rotational speed of the shaft 24, the power output of the turbine 12, a flow rate of combustion gases, pressure data, or some combination thereof. Additionally, some parameters may relate to a control input of the turbine engine 12. For example some parameters may relate to a specified power level or operating state of the turbine engine 12, an elapsed time period since start-up of the turbine engine 12, or a start-up and/or shut-down input.

The one or more parameters of the turbine engine 12 monitored at block 122 may then be used use to determine a desired clearance setting at decision blocks 124, 128, and 132. For instance, at decision block 124, a determination is made regarding whether the parameters indicate a transient state of the turbine engine 12, i.e. a state in which a changing parameter of the turbine engine 12 may have a tendency to cause rapid changes in the clearance. For example, one or more parameters may relate to a temperature of the turbine housing 40, the blades 36, or some other component of the turbine engine 12. If the temperature is detected as rapidly changing, this may indicate that the turbine engine 12 is in a transient state such as startup or shutdown.

If such a transient state is detected, the method 120 may proceed to block 126, at which the shroud is magnetically actuated to maintain a desired clearance setting that corresponds to a transient state of operation. In one embodiment, the method 120 may magnetically actuate the movable shroud portions 54 to a maximum clearance setting. By setting the clearance to a maximum level, the possibility of contact between the inner wall 38 of the shroud and the turbine blades 36 may be minimized. For instance, to achieve the maximum clearance setting, the clearance controller 46 may reduce or eliminate a current flow to the coils 74 of one or more of the magnets 70 and 72. Thus, as the repulsive force of the magnets is removed, the springs 100 may retract the movable shroud portions 54 outward and away from the rotational axis 62 (e.g., in the direction of arrow 98 of FIG. 3). Thereafter, the method 120 may return to block 122 and continue to monitor operating parameter(s) of the turbine engine 12.

In one embodiment, the determination of whether the turbine engine 12 is operating in a transient state or a steady-state condition may also be based on empirical measurements or theoretical estimates regarding the amount of time that the turbine engine 12 takes to reach a steady state after start-up or after some other change in the power setting of the turbine engine 12. The empirical data may be used to program specified time-constants into the clearance controller 46 representing the amount of time taken to achieve steady-state conditions after certain changes in the power setting of the turbine engine 12 have been initiated. For instance, after a particular change in the power setting of the turbine engine 12 has taken place, the clearance controller 46 may keep track of the amount of time that has elapsed since the change in the power setting to determine whether the turbine engine 12 is in a transient state or a steady state. If the elapsed time is greater than the specified time-constant, this may indicate that the turbine engine 12 has reached steady-state operating condition. If, however, the elapsed time is less than the specified time-constant, this may indicate that the turbine engine 12 is still in a transient operating state.

Returning to decision block 124, if the monitored parameters are not indicative of a transient state, then the method 120 may continue to one of the steady-state decision blocks 128 or 132. For example, if it is determined that the measured parameter (e.g., temperature) is relatively constant over a period of time, this may indicate that the turbine engine 12 has reached a steady-state operating condition. Thus, the method 120 may proceed through the decision logic depicted by blocks 128 and 130 to determine whether the turbine 20 is operating in a full-power steady-state condition or a turndown steady-state condition. Accordingly, the magnetic actuation of the movable shroud portions 54 may be determined based on the power setting of the turbine engine 12, as will be discussed below.

Continuing to decision block 128, a determination is made as to whether the parameters indicate that the turbine engine 12 is operating at full-power, steady-state conditions. If the monitored parameters indicate a full-power steady-state condition, the method 120 may magnetically actuate the movable shroud portions 54 at block 130 to a pre-determined displacement to provide a radial gap 56 that is intended to provide a minimum clearance for the full-power steady-state conditions. In some embodiments, the pre-determined displacement of each movable shroud portion 54 may be based on empirical measurements or theoretical estimates regarding the level and/or rate of expansion and/or distortion of the turbine housing 40, turbine blades 36, etc., that may be expected at full-power steady-state operating conditions. Thereafter, the method 120 may return to block 122 and continue to monitor operating parameter(s) of the turbine engine 12. By way of example only, the clearance setting for a full-power steady-state operating condition may be less than the clearance setting for the transient operating condition discussed above.

If at decision block 128, it is determined that the monitored parameters are not indicative of a full-power steady-state operating condition, the method 120 continues to decision block 132, wherein a determination is made as to whether the monitored parameters indicate that the turbine engine 12 is operating at turndown, steady-state conditions (e.g., 50% or less of the full-power setting). If so, the method 120 may magnetically actuate the movable shroud portions 54 at block 134 to a pre-determined displacement to provide a radial gap 56 that is intended to provide a minimum clearance for the turndown steady-state conditions. As mentioned above, the pre-determined displacement of each movable shroud portion 54 may be based on empirical measurements or theoretical estimates regarding the level and/or rate of expansion and/or distortion of the turbine housing 40, turbine blades 36, etc., that may be expected at turndown steady-state operating conditions. Furthermore, in some embodiments, several turndown settings may be programmed into the clearance controller 46 to correspond with various power settings of the turbine engine 12. Once the movable shroud portions 54 are adjusted accordingly, the method 120 may return to block 122 from block 134 and continue to monitor operating parameter (s) of the turbine engine 12. Additionally, the method 120 may also return to block 122 from decision block 132 and continue monitoring turbine parameters if a turndown steady-state condition is not detected at decision block 132.

As described above, the clearance controller 46 may be programmed to provide two or more discrete clearance settings which may be selected depending, at least in part, on whether the turbine engine 12 is operating in a steady-state operating condition (e.g., full-power and turndown). Turning now to FIG. 8, a method 140 for adjusting clearance gradually in real-time is shown, in accordance with embodiments of the present technique. Using the method 140, a desired clearance may be maintained regardless of whether the turbine engine 12 is operating in a steady-state or a transient condition.

As shown in FIG. 8, the method 140 begins at block 142, wherein a desired clearance is determined. The desired clearance may be determined based at least partially on the operating conditions of the turbine engine 12, as generally discussed above with reference to FIG. 7. For example, during start-up of the turbine engine 12, vibrations in the turbine 20 may tend to cause the radial gap 56 to change or vary rapidly. Therefore, to reduce the possibility of a rub during start-up, the desired clearance may be set to a relatively large value during periods of increased vibration levels, as measured by one or more turbine sensors 48. For example, signals representative of the vibration levels (e.g., sensed data 50) may be sent to the clearance controller 46 as described above in relation to FIG. 1 for determination of the desired clearance. In some embodiments, block 142 may be repeated on a periodic basis or may be repeated in response to a change in an operating condition of the turbine engine 12, such as initiation of a shutdown, turndown or some other change in the operating state of the turbine engine 12. Furthermore, the desired clearance may be gradually adjusted through a continuous range of clearance values (e.g., by modulating the currents supplied to coils 74 of magnets 70 and 72)

The method 140 may also involve measuring the actual clearance, as indicated by block 144. For instance, the actual clearance may be measured by each of the proximity or clearance sensors 102 coupled to each of the movable shroud portions 54 around the circumference of the turbine housing 40 and sent to the clearance controller 46 (as feedback data signals 104 shown in FIGS. 3 and 4). Next, at decision block 146, a determination is made as to whether the actual clearance measured at block 144 is equal to the desired clearance determined at block 142. If the actual clearance is not equal to the desired clearance, the method 140 continues to block 148, wherein the clearance is adjusted according to the desired clearance. For instance, the clearance adjustment process may include providing an independent clearance adjustment control action for each of the movable shroud portions 54 within the turbine housing 40. That is, the position of each of the movable shroud portions 54 may then be magnetically actuated, as discussed above in relation to FIGS. 3 and 4, to bring the actual clearance into closer alignment with the desired clearance. As shown in FIG. 8, following block 148, the method 140 may return to decision block 146. In some embodiments, the blocks 146 and 148 may be repeated on a periodic basis to maintain the desired clearance. Additionally, as shown by block 150, if the actual and desired clearances are determined to be equal, the method may end the adjustment process.

While the depicted method 140 shows that the adjustment process may end (block 150) once a desired clearance is achieved, in further embodiments the method 140 may be repeated at discrete short intervals to provide a near continuous, real-time monitoring and adjustment of the clearance. By continually adjusting the clearance in real time, a generally constant clearance may be maintained as the thermal response of the turbine 20 causes the blades 36 and/or the turbine housing 40 to contract or expand during operation. For example, as the turbine 20 heats up due to the combustion gases flowing out of the combustor section 18, the turbine blades 36 may tend to radially expand. As the turbine blades 36 radially expand, the movable shroud portions 54 may be adjusted outward (in direction of the arrow 98 in FIG. 3) to maintain a desired blade clearance.

It should be further appreciated that while the present examples have generally described the application of the clearance control techniques described herein with regard to a turbine of a turbine engine system, the foregoing techniques may also be applied to a compressor of the turbine engine system, as well as to any type of system that includes a stationary component and a rotary component and wherein a clearance is to be maintained between the stationary and rotary components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a shaft comprising an axis of rotation;

a plurality of blades coupled to the shaft;

a shroud comprising a plurality of segments disposed circumferentially about the plurality of blades, wherein each segment comprises:

a fixed shroud portion comprising a first magnet; and a movable shroud portion comprising a second magnet opposite from the first magnet, wherein at least one of the first or second magnets comprises an electromagnet, the movable shroud portion is magnetically actuated by the first and second magnets to move in a radial direction relative to the axis to adjust a clearance between the plurality of blades and the movable shroud portion, and the first and second magnets are disposed in a cavity located between the fixed shroud portion and the movable shroud portion.

2. The system of claim 1, wherein the plurality of blades and the shroud are disposed in a turbine section of the turbine engine.

3. The system of claim 1, wherein the plurality of blades and the shroud are disposed in a compressor section of the turbine engine.

4. The system of claim 1, comprising a clearance controller coupled to a clearance sensor configured to measure the clearance between the plurality of blades and the shroud.

5. The system of claim 1, comprising a clearance controller coupled to a plurality of clearance sensors configured to measure clearances between the plurality of blades and each movable shroud portion of the plurality of segments.

6. The system of claim 5, wherein the clearance controller is configured to independently control the clearances via magnetic forces between the first and second magnets in the fixed and movable shroud portions of each segment.

7. The system of claim 1, comprising a clearance controller configured to adjust the clearance based on one or more parameters indicative of a transient condition, a steady-state condition, a turndown condition, or a combination thereof.

8. The system of claim 7, wherein the one or more parameters comprise a speed, a temperature, a vibration, a pressure, a time, a power output, a flow rate, a start-up input, a shutdown input, or a combination thereof.

9. The system of claim 1, wherein the movable shroud portion comprises a pair of rails oriented in a circumferential direction relative to the axis, the fixed shroud portion comprises a pair of grooves oriented in the circumferential direction relative to the axis, the rails and grooves couple with one another in the circumferential direction, and the rails and grooves enable a limited range of radial movement in the radial direction.

10. The system of claim 9, comprising a spring biasing the movable shroud portion in the radial direction toward a maximum value of the clearance.

11. A system, comprising:

an annular shroud configured to extend around a plurality of blades of a compressor or a turbine, wherein the annular shroud comprises:

a fixed shroud portion comprising a first electromagnet; and a movable shroud portion comprising a second electromagnet, wherein the movable shroud portion is magnetically actuated by the first and second electromagnets to move in a radial direction relative to a rotational axis of the blades to adjust a clearance between the plurality of blades and the movable shroud portion, and the first and second electromagnets are disposed in a cavity located between the fixed shroud portion and the movable shroud portion.

12. The system of claim 11, comprising a clearance controller configured to adjust the clearance based on one or more parameters indicative of a transient condition, a steady-state condition, a turndown condition, or a combination thereof.

13. The system of claim 12, wherein the one or more parameters comprise a speed, a temperature, a vibration, a pressure, a time, a power output, a flow rate, a start-up input, a shutdown input, or a combination thereof.

14. The system of claim 11, comprising a clearance controller configured to adjust the clearance based on a clearance measurement at one or more circumferential positions about the rotational axis.

15. The system of claim 11, wherein the movable shroud portion comprises a pair of rails oriented in a circumferential direction relative to the rotational axis, the fixed shroud portion comprises a pair of grooves oriented in the circumferential direction relative to the rotational axis, the rails and grooves couple with one another in the circumferential direction, and the rails and grooves enable a limited range of radial movement in the radial direction.

16. The system of claim 15, comprising a spring biasing the movable shroud portion in the radial direction toward a maximum value of the clearance.

17. The system of claim 11, wherein the annular shroud comprises a plurality of segments, each segment comprising one of the fixed shroud portion with one of the first electromagnet, one of the movable shroud portion with one of the second electromagnet, and a biasing mechanism configured to bias the respective movable shroud portion in the radial direction toward a maximum value of the clearance, further comprising a clearance controller coupled to a plurality of clearance sensors configured to measure clearances between the plurality of blades and each respective movable shroud portion of the plurality of segments, wherein the clearance controller is configured to independently control the clearances via magnetic actuation of the first and second electromagnets in the fixed and movable shroud portions of each segment.

18. A system, comprising:

a turbine clearance controller configured to independently adjust clearances of a plurality of shroud segments about a plurality of blades via first and second magnets opposite from one another in fixed and movable portions of each shroud segment, wherein the first and second magnets are disposed in a cavity located between the fixed and movable portions of each shroud segment.

19. The system of claim 18, wherein the clearance adjustment of each of the plurality of shroud segments is based at least partially upon on individual clearance measurements for each shroud segment.

20. The system of claim 18, wherein the clearance adjustment of each of the plurality of shroud segments is based at least partially upon whether the system is in a transient state or a steady-state of operation.

* * * * *